United States Patent [19]

Larsson et al.

[11] Patent Number: 4,634,213

[45] Date of Patent: Jan. 6, 1987

[54] CONNECTORS FOR POWER DISTRIBUTION CABLES

[75] Inventors: Peter L. Larsson, Mountain View; Robert Parker, Alamo; Thomas D. Ratzlaff, Menlo Park, all of Calif.

[73] Assignee: Raychem Corporation, Menlo Park, Calif.

[21] Appl. No.: 598,557

[22] Filed: Apr. 9, 1984

Related U.S. Application Data

[63] Continuation-in-part of Ser. No. 483,997, Apr. 11, 1983, abandoned.

[51] Int. Cl.[4] ..... H01R 11/06

[52] U.S. Cl. ..... 339/275 T; 29/860; 174/84 R

[58] Field of Search ..... 29/860; 228/563; 339/275, 273 S; 174/DIG. 8, 84 R, 94 R

[56] References Cited

U.S. PATENT DOCUMENTS

| | | | |
|---|---|---|---|
| 2,146,393 | 2/1939 | Burrell | 339/275 C |
| 2,664,844 | 1/1959 | Siegrist et al. | 339/275 C |
| 2,831,446 | 4/1958 | Schwartz | 339/275 C X |
| 2,838,593 | 6/1958 | Scesa et al. | 339/275 C X |
| 3,326,442 | 6/1967 | Fattor | 339/275 T X |
| 3,396,460 | 8/1968 | Wetmore | 228/56.3 X |
| 3,396,894 | 8/1968 | Ellis | 228/56 |
| 3,399,270 | 8/1968 | Stoddard | 174/94 R X |
| 3,402,758 | 9/1968 | Cushman | 164/108 |
| 3,525,799 | 8/1970 | Ellis | 228/56.3 X |
| 3,578,896 | 5/1971 | Lynch | 174/84 |
| 3,601,783 | 8/1971 | Loose | 339/223 |
| 3,665,367 | 5/1972 | Keller et al. | 339/275 T |
| 3,676,575 | 7/1972 | Weaver et al. | 174/94 |
| 4,174,563 | 11/1979 | Simpson | 174/DIG. 8 X |

FOREIGN PATENT DOCUMENTS

| | | |
|---|---|---|
| 13-3755 | 3/1938 | Japan . |
| 45-30385 | 10/1970 | Japan . |
| 45-30139 | 9/1970 | Japan . |
| 49-126184 | 10/1974 | Japan . |
| 51-6482 | 1/1976 | Japan . |
| 55-121479 | 8/1980 | Japan . |
| 58-66572 | 5/1983 | Japan . |
| 598845 | 2/1948 | United Kingdom . |
| 614823 | 12/1948 | United Kingdom . |
| 688172 | 2/1953 | United Kingdom . |
| 710778 | 6/1954 | United Kingdom . |
| 659113 | 10/1957 | United Kingdom . |
| 661202 | 11/1957 | United Kingdom . |
| 1006396 | 9/1965 | United Kingdom . |
| 1022982 | 3/1966 | United Kingdom . |
| 1042066 | 9/1966 | United Kingdom . |
| 1142459 | 2/1969 | United Kingdom . |
| 1244954 | 9/1971 | United Kingdom . |
| 1485051 | 9/1977 | United Kingdom . |
| 1544201 | 4/1979 | United Kingdom . |

*Primary Examiner*—Eugene F. Desmond

*Attorney, Agent, or Firm*—Edith A. Rice; Herbert G. Burkard

[57] ABSTRACT

Connectors for terminating and splicing high voltage power cables comprise a metallic tubular sleeve having an open end for receiving an electrical conductor and a closed end. The inner wall of the sleeve is pretinned. The sleeve can be provided with a slug of solder proximate to the closed end. A connection is made by inserting the conductor into the sleeve, heating the solder, and as the solder melts, relatively moving the connector and the conductor toward each other. The connector can be provided with an insert to accommoduate conductors that are non-circular in cross-section.

The connector can be provided with means for pressuring the slug of solder toward the open end of the sleeve at the temperature at which the slug of solder melts. With this connector, no relative movement between the conductor and the connector is required. Merely by melting the solder, the means for pressuring causes the solder to extrude around the conductor.

29 Claims, 12 Drawing Figures

CONNECTORS FOR POWER DISTRIBUTION CABLES

This application is a continuation-in-part of application Ser. No. 483,997, filed Apr. 11, 1983, now abandoned.

BACKGROUND

The present invention is directed to connectors for power distribution cables, and methods for use of the connectors.

A variety of techniques have been developed for terminating or splicing high voltage cables in the field. High voltage cables are used for distributing power, and can vary in size from #4 gauge up to over 3,000 MCM.

One technique commonly used is a compression crimp with a metallic sleeve. However, there are problems with compression crimps. For example, heavy hydraulic crimping tools are required, which can weigh 50 to 100 pounds. These heavy tools are awkward to use in the field. In addition, a large number of dies are required because a die is needed for each cable size. If the die size is off by even a small fraction, which easily occurs due to die wear, the tool does not perform satisfactorily and crimp failure can result.

Another problem with compression crimps is lack of reliability, especially with aluminum conductors. If an unsatisfactory crimp is formed, the termination or splice can overheat which can result in a fire, system failure, and a blackout.

When a compression crimp is used, often the crimp is filled with a conductive grease to insure better electrical contact and to prevent oxidation. In the field, this conductive grease is very messy. At high temperature the grease can flow resulting in poor electrical contact.

Another problem noted with compression crimps, particularly for aluminum conductors, is that cold flow occurs due to thermal cycling. This can result in a thermal runaway which can cause a fire.

Another technique for forming terminations and splices that has been used is sweating, where hot molten solder is poured into the termination or splice. This also is a very difficult technique to use in the field. A hot tub of solder is required, which creates safety hazards and there are significant losses of expensive solder. Further, temperature control is essential to a good splice or termination, and is difficult to achieve in the field. If the temperature is too low, a satisfactory connection does not result due to a poor metallurgical bond. If the temperature is too high, flux in the solder degrades, resulting in a brittle connection which can fail. Hence, there is considerable worker skill required.

Another technique that has been considered is a chemical heating system, known under the tradename Cadweld, for welding conductors together using an exothermic reaction and molten aluminum. This technique has achieved only limited use because it can be dangerous, it involves a gas which needs venting which is difficult in the field, and it is expensive because the molds used wear out after only fifty uses.

One further technique that has been considered is metal inert gas (MIG) welding, that is welding the aluminum conductors under inert gas to prevent oxidation of the aluminum. This technique requires expensive equipment which is generally unsuitable for field use in that it weighs several hundred pounds or more and is not easily portable.

In view of these problems, there is a need for a method for connecting high voltage electrical conductors that is safe, easy to use, and reliable. There is also a need for connectors to be used in the method.

SUMMARY

The present invention satisfies these needs by providing novel connectors for electrical conductors and novel methods for using the connectors. An electrically conductive connector according to the present invention comprises at least one metallic tubular sleeve having an open end for receiving an electrical conductor and a closed end. A single sleeve is used for termination connections and two sleeves in electrically conductive connection are used for splice connections. The peripheral inner wall of the sleeve is pretinned, such as with a solid coating of solder or zinc thereon. The sleeve is sized to receive a slug of solder proximate to the closed end. The connector can be provided with the slug of solder in position, or the user of the connector can add the slug of solder in the field.

This connector is used in the method of the present invention by heating the sleeve to melt the solder while simultaneously applying a force to relatively move the connector and the conductor toward each other. Until the slug of solder has at least softened, no relative movement between the connector and the conductor is possible. When the solder has melted, the sleeve and the conductor are moved relatively toward each other. The sleeve is continued to be heated and simultaneously the sleeve and conductor are continued to be moved relatively toward each other to extrude solder toward the open end of the sleeve. This completely fills any interstices in the conductor, such as spaces between strands of stranded conductors, and also completely fills the space between the conductor and the sleeve with solder. Preferably the heating and the moving continue until the conductor can no longer move, i.e., it bottoms out in the connector. Preferably the size of the slug of solder is chosen as that as the conductor bottoms out, a small portion of the solder is extruded out of the sleeve, which indicates to an operator that connection has been made.

In some circumstances, it is not possible to move the sleeve and the conductor toward each other. For instance, when splicing two electrical conductors together, after the first conductor is connected to the connector, the connector can no longer be moved, and often the other conductor is relatively immobile. To overcome this problem, the connector can have means for pressuring the slug of solder towards the open end of the sleeve at Tm, the temperature at which time slug of solder melts. In this version of the invention, the conductor and connector are held immobile, while the pressuring means extrudes the solder around the conductor and into the interstices of the conductor.

Preferably the pressuring means produces a force at Tm of at least 10 psi, and more preferably at least 30 psi, to achieve adequate filling of space between strands. Preferably the pressuring means produces a force of Tm no greater than 200 psi to prevent the conductor from being forced out of the sleeve.

Exemplary of suitable pressuring means are (1) a spring; (2) a heat expandable metal which can be in the form of a spring; (3) a swellable polymer; (4) a gas; (5) a container containing pressurized gas that is released at a temperature greater than 100° C. and up to Tm; (6) reactants that evolve a gas, the reactants being separated by a barrier that allows the reactants to react at a temperature greater than 100° C. and up to Tm; and (7) reactants that evolve gas when they react, the reactants being reactive only at a temperature between 100° C. and Tm.

A connector containing pressuring means, referred to as a "self-activated connector" herein, can include a metallic barrier between the slug of solder and the pressuring means, the barrier acting as a piston and being dimensionally stable at Tm and axially slidable within the sleeve. Preferably the connector includes sealing means for preventing leakage of the pressuring means past the barrier, particularly when the pressuring means comprises a material that is a fluid at Tm.

The pressuring means can also comprise an external source of compressed gas. In this version of the invention, there is a gas port through the wall of the sleeve proximate to the closed end for introducing pressurized gas into the sleeve.

The connector can be provided with a tubular insert for use with conductors that are non-circular in transverse cross-section. The tubular insert is metallic, rotatably positioned in the sleeve, and the peripheral inside wall of the insert is pretinned. The inside wall of the insert is non-circular in transverse cross-section, having a cross-section that corresponds to the cross-section of the conductor.

The connector can have a view hole through the wall of the sleeve proximate to the open end of the sleeve for determining when the slug of molten solder has been extruded to a position proximate to the open end of the sleeve.

So that a single sleeve can accommodate more than one conductor size, inserts of varying wall thickness can be provided, where the peripheral inner wall of each insert is pretinned. Alternatively, a flexible metallic sheet coated with solder can be provided. The sheet is wrapped around the conductor until the outer diameter of the wrapped conductor is sufficiently larger for the internal diameter of the connector.

This method for making splices or connections is safe, reliable, and easy to use in the field. The only significant piece of equipment required is a torch. The resulting terminations and splices are electrically reliable and physically secure. This method can be used for both aluminum and copper conductors, and also can be used for splicing an aluminum conductor to a copper conductor.

DRAWINGS

These and other features, aspects, and advantages of the present invention will become better understood with reference to the following description, appended claims, and accompanying drawings where:

Figure 8A:
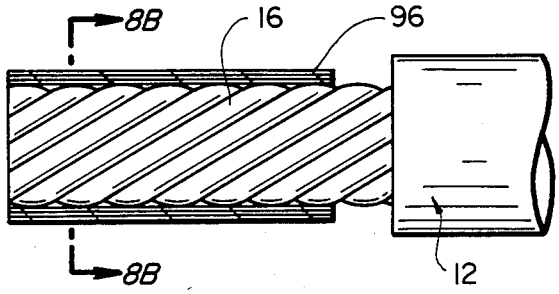
Figure 8B:
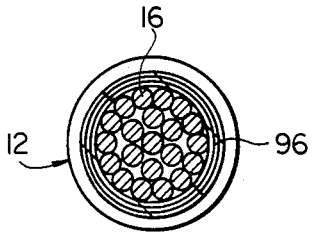
Figure 9:
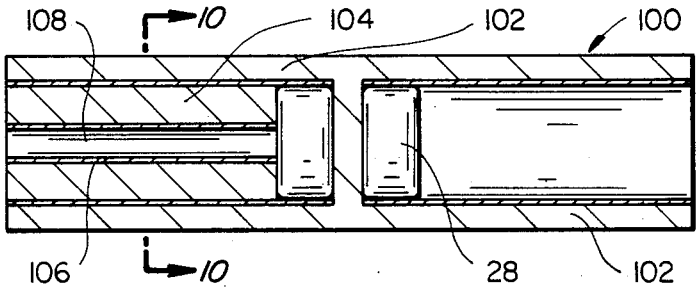
Figure 10:
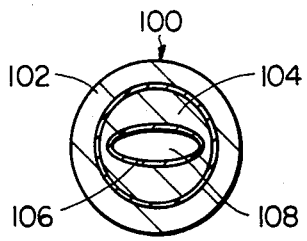

Each of FIGS. 3–7 shows a self-activated termination connector according to the present invention provided with means for pressuring molten solder toward the open end of the connector;

FIG. 8A is a front elevation view of a power cable where the conductor is wrapped in a pretinned flexible sheet of metal;

FIG. 8B is a transverse cross-section view of the cable of FIG. 8A taken on line 8—8 in FIG. 8A;

FIG. 9 shows in transverse cross-section a splice connector according to the present invention having an insert therein; and FIG. 10 is a view of the splice connector of FIG. 9 taken along line 10—10 in FIG. 9.

DESCRIPTION

With reference to FIG. 1, an electrically conductive connector 10 according to the present invention is used for terminating a power cable 12 that comprises insulation 14 that has been cut back to expose a stranded conductor 16. As used herein, the term "connector" refers to connectors that are used both for terminating power cables and for splicing power cables together.

The connector 10 can be used for a large variety of power cables, including cables ranging in size from #4 gauge to over 3,000 MCM. This corresponds to 16 square millimeters to over 1,500 square millimeters in European notation.

The connector 10 can be used with cables insulated with a polymeric material or oil saturated paper. The conductor 16 can be stranded or solid. The cable 12 can be multi-conductor sectored cable having conductors that are non-circular in transverse cross-section.

The conductors can be formed of copper or aluminum, and a copper conductor can be spliced to an aluminum conductor.

As shown in FIG. 1, the connector 10 comprises a metallic tubular sleeve 18 having a closed end 20 and an open end 22. Although the connector 10 is shown with a sleeve that is cylindrical, other shaped sleeves can be used, including sleeves of irregular cross-section.

The connector 10 is pretinned such as with a thin, solid coating of solder 24 on the inner peripheral wall 26 of the sleeve 18. There is also a slug of solder 28 in the sleeve proximate to the closed end 20.

As used herein the term "pretinned" means that a surface has been coated with solder or solder-like material such as zinc or bronze. Although the invention will be discussed below principally with regard to pretinning with solder, it is to be understood that coatings other than solder can be used.

Preferably the sleeve 18 is formed from the same material used for the conductor, which in the case of the aluminum conductors can be 1100 series aluminum alloys.

The same solder, which can be a fluxless solder, can be used both for the coating 24 and the slug 28. A preferred solder for a copper conductor contains tin, cadmium and zinc, and is available under the tradename Neptune-SS from Rock Mount Research and Alloys, Inc. of Denver, Colo. A preferred fluxless solder for an aluminum conductor contains zinc, aluminum, copper, iron, and magnesium, and is available under the tradename Neptune-S from Rock Mount. Solder used in conjunction with a flux can also be used. Insuch event, it is preferred to use a multi-cored solder such as for example a solder comprising lead, tin and optionally silver. Multi-cored solder typically is an extruded rod of solder containing two or more areas of flux extending longitudinally within the solder rod. A multi-cored solder of this type is commercially available from Multi-Cored Solders, Ltd. of Great Britain and under the trademark HMP Solder.

The thickness of the coating 24 of solder can be in the order of a few ten thousandths of an inch, and generally is in the order of a few thousandths of an inch. The pretinning can be achieved by heating the sleeve 10 and melting solder onto the inner peripheral wall 26 or by electroplating.

Preferably the area of a transverse cross-section of the wall of the sleeve 18 is at least equal to the area of a transverse cross-section through the conductor 16 so that the connector and the conductor have the same capability to conduct electricity. This avoids hot spots in the termination or splice.

The internal diameter of the sleeve 18 must be larger than the outer diameter of the conductor 16, and preferably is at least 5 mils greater.

The solder 28 can be pre-placed in the sleeve 18, or the user of the connector can place the solder. When the solder is pre-placed, it can be melted for placement in the sleeve, and when it solidifies it attaches to the walls of the sleeve and securely stays in place.

To use the connector 10, the conductor 16 is inserted into the sleeve, bottoming out on the slug 28 of solder. Then the sleeve is heated such as by a torch 30 while simultaneously forcing the connector and the conductor towards each other with a force of at least about 10, preferably at least about 30 pounds. When the solder melts, the force results in the sleeve and the conductor moving relatively toward each other. This results in the solder being extruded toward the open end of the sleeve under pressure. The pressurized solder fills any interstices in the conductor, including spaces between strands, completely fills the space between the conductor and the sleeve, and fills the closed end of the sleeve as shown by reference number 31 in FIG. 1B.

Filling the closed end of the sleeve with solder is important in that it provides good electrical contact between the end of a conductor and the connector. Such contact is absent in a crimp connection.

The relative movement between the conductor and the solder in a closed environment tends to encourage a metallurgical bond and a high-quality connection.

Preferably, any oxide on the conductor is mechanically removed such as with a stainless steel brush before the conductor is inserted into the connector. Preferably any oxide film on the inner peripheral wall of the sleeve is removed by mechanical abrasion or an ultrasonic technique before pretinning the sleeve to aid in formation of a metallurgical bond between the conductor and the connector.

The conductor and connector are moved relatively toward each other until the conductor bottoms out in the sleeve and cannot be forced any further. Generally, a small portion of the solder is extruded out of the sleeve as shown by reference numeral 33 in FIG. 1B when bottoming out occurs this helps let the operator know that the connection is complete. The heat is then removed, and the conductor and connector are allowed to cool. This process results in a strong and electrically conductive metallurgical bond between the conductor and the connector.

The slug of solder has sufficient mass to completely fill any interstices in the conductor, to fill the space between the conductor and the sleeve, and to allow a small portion to be extruded out of the sleeve.

The sleeve 18 can be formed from a tube that is crimped down to form a closed end 20. With this configuration, there can be an opening toward the closed end. An advantage of the present invention is that molten solder is extruded into any openings to close them off. The mass 31 of solidified solder stops ingress by water and other contaminants.

Figure 2:
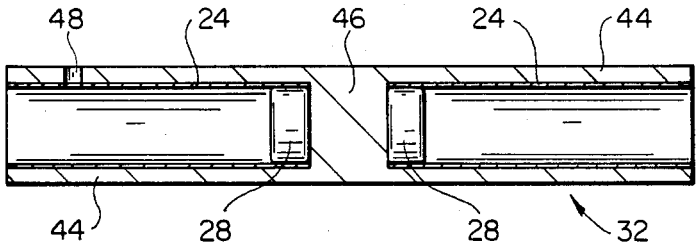
FIG. 2 shows in transverse cross-section a splice connector according to the present invention.

FIG. 2 shows a splice connector 32 according to the present invention that comprises two axially aligned metallic tubular sleeves 44 in electrically conductive connection with each other. This connector 32 can be formed from a single metal tube that has a barrier 46 therein. The barrier 46 can be held in place by soldering, welding, an interference fit, or a press fit. Each sleeve 44 is pretinned on its inner peripheral wall with a solid coating 24 of solder and has a slug 28 of solder at its closed end.

One of the sleeves is shown as having a view hole 48 through its wall so that operator can observe molten solder as it is extruded toward the open end, and stop heating the solder before it extrudes out of the sleeve. Although only one of the sleeves is shown as having a view hole 48 in FIG. 2, clearly both sleeves can be provided with a view hole.

The splice connector 32 is used in the same manner as the termination connector 10. That is, each of two conductors is connected to one of the sleeves in the same manner as described above with regard to termination connector 10. The two conductors can be attached to the connector simultaneously, or connection can be done sequentially.

Splice connectors comprising more than two sleeves can be used. For example, splice connectors having three sleeves in the form of a "Y" or "T" can be used, and splice connectors having four sleeves in the form of an "H" can be used.

FIGS. 3–7 show self-activated connectors having means provided for pressuring the solder to the open end of the sleeve when the solder melts. Although the pressuring means is only shown with regard to termination connectors, the pressuring means can be used with one or both sleeves of a splice connector such as the splice connector 32 shown in FIG. 2. As noted above, it is with splice connectors that the pressuring means are most useful. With splice connectors, often once one conductor is connected, it is impossible to have relative movement between the connector and the second conductor. With a self-activated connector, relative movement is not required.

In FIGS. 2–7, the same reference numerals are used as in FIG. 1 to show elements that are substantially the same.

Figure 3:
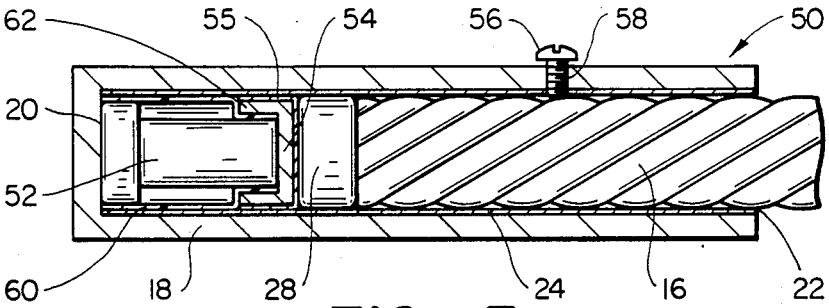

In FIG. 3, the pressuring means comprises a solid cylinder 52 of a heat swellable or foamable polymer. Between the cylinder 52 and the slug of solder 28 is a barrier or piston 54. The piston 54 is axially slidable within the sleeve 18 and is made of a material that is thermally stable and does not melt at the temperature, Tm, at which the slug of solder 28 melts. The piston 54 can be made of the same alloy used for the sleeve. Preferably the piston 54 is pretinned with a coating 55.

When heat is applied to the connector 50, the polymer increases in size. Once the slug of solder 28 melts, the polymer forces the piston 54 and the solder 28 toward the open end 22 of the sleeve 18. To prevent the conductor 16 from being forced out of the sleeve, it is held in place by a fastener such as a screw 56 extending through a fastening hole 58 in the wall of the sleeve 18 proximate to the open end 22 of the sleeve. An alternate approach to prevent conductor "pull out" is the provision of a star-shaped washer about 3 to 5 mils thick proximate the open end of the sleeve. Such a star-shaped washer has a smooth outer circumference and an inner circumference having a plurality of points. When positioned in the sleeve the smooth outer surface fits against the inner peripheral wall of the sleeve and the points of the star extend inwardly. The points of the stat contact and grip the conductor when it is inserted in the sleeve. As the conductor is forced into the connector the sharp inner circumference of the washer scrapes the conductor removing any oxide layer that might be present. In addition, the washer firmly holds the conductor in place and acts as a dam to retain the solder, when molten, within the sleeve.

Figure 4:
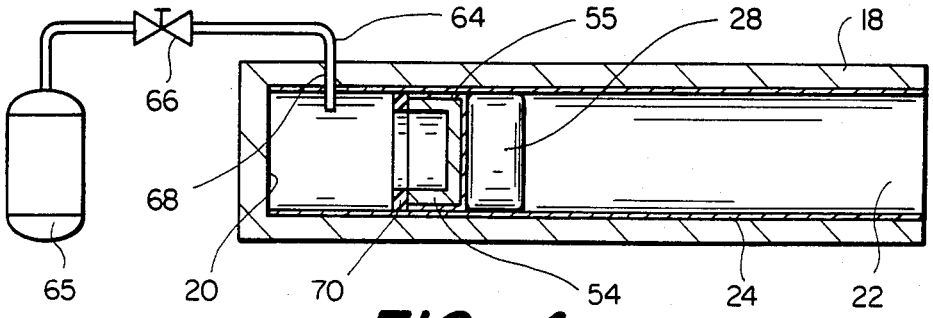
Figure 5:
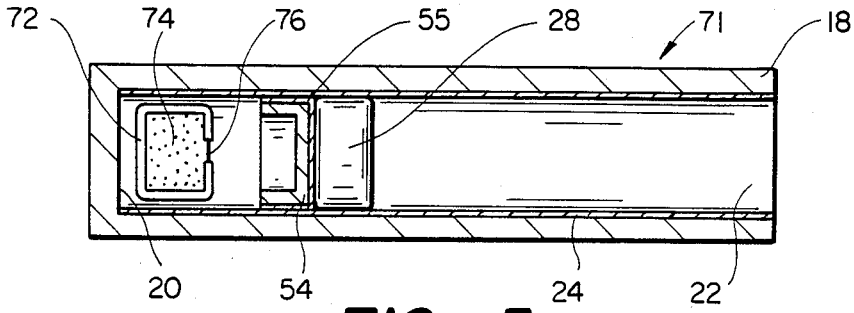
Figure 7:
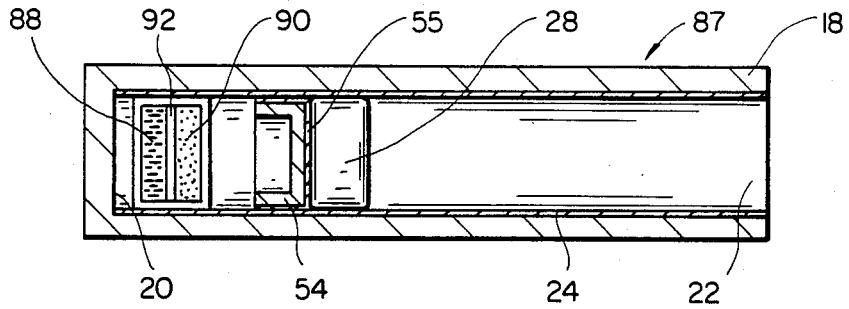

To prevent the polymer from leaking out around the piston 54, a high temperature polymeric sealing sleeve member 60 is provided on the inner peripheral wall of the sleeve 18 adjoining the cylinder 52. As the polymer swells, it forces the sealing member 60 against the inner peripheral wall of the sleeve. The piston 54 has a skirt 62 extending toward the closed end 20 of the sleeve 18 and the sealing member 60 is pressured against the inner wall of the skirt 62, thus preventing leakage of the swellable polymer 52 beyond the piston. The polymeric sealing member 60 is particularly useful when the pressuring means is a fluid as shown in FIGS. 4, 5 and 7. The sealing member 60 can be made from a flexible heat-resistant material such as thin aluminum or a polymeric material, preferably a sheet of a polyimide available under the tradename Kapton from DuPont. A suitable sleeve can be made from 3 to 4 wraps of 1 mil thick Kapton.

Preferably the pressuring means produces a force on the piston at Tm, which is generally about 150° to 400° C. for solders for aluminum and copper conductors, of at least 10 psi, and more preferably at least 30 psi on the piston, to achieve adequate filling of the space between strands and extrude solder all the way toward the open end. Preferably the pressuring means produces a force at Tm less than 200 psi on the piston to prevent the conductor and the piston from being entirely forced out of the sleeve.

A preferred material for the polymer contains:
low density polyethylene: 80 pbw (parts by weight)
ethylene ethylacrylate: 20 pbw
hindered phenol antioxidant: 0.5 pbw
p-oxy bis(benzene sulfonyl hydrazide) (foaming agent): 2 pbw The foaming agent is available under the tradename Celagen from Uniroyal. Other sulfonyl hydrazide foaming agents can be used.

Other suitable polymers can include polyethylene, ethylene vinyl acetate and polypropylene that have been cross-linked by radiation to prevent them from oozing out by the piston 54. Also polymers such as silicone polymers having a foaming agent therein can be used.

With reference to FIG. 4, the pressure to move the piston 54 of the connector 59 can be provided by an external gas source in a gas cylinder 65. The gas cylinder 65 is connected by a line 64 having a valve 66 to a port 68 proximate to the closed end of the sleeve. A gasket 70 is provided to prevent the gas from leaking past the piston. Preferably a non-reactive gas such as nitrogen is used.

With reference to FIG. 5, a connector 71 is provided with pressuring means comprising a cylinder 72 containing compressed non-reactive gas 74. The cylinder is closed with a solder plug 76. As the connector 71 is heated, the plug of solder 76 melts, thereby releasing the compressed gas 74, which drives the piston 54 and the slug of solder 28, once it is melted, toward the open end of the sleeve.

Figure 6:
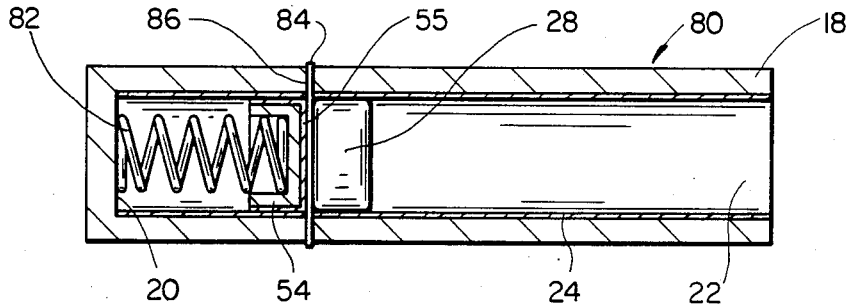

With reference to FIG. 6, a connector 80 has a spring 82 as the pressuring means. The spring is made of a material that does not lose its temper at the temperature, Tm, at which the solder melts, i.e., at 360° to 400° C. Suitable materials for the spring 82 include 302 stainless steel, SAE 52100 alloy carbon steel, T1 High speed tool steel, steel alloy 8286 and Inconel 718. The spring 82 can be made from a heat-recoverable metal that expands upon heating such as nitinol, a nickel-titanium based alloy available under the trademark Tinel.

To hold the piston 54 in place in the version of the invention shown in FIG. 6, a solder pin 84 is provided. The pin 84 extends through two aligned openings 86 in diametrically opposite portions of the sleeve. The pin preferably is made of the same solder used for the slug 28 so that when the pin 84 melts, the slug of solder 28 is molten as it is forced by the spring 82 toward the open end of the sleeve.

As shown in FIG. 7, a connector 87 can have as pressuring means two reactants 88 and 90 separated by a barrier 92 that melts at a temperature greater than 100° C. up to Tm. The barrier 92 can be made of solder. The reactants can be materials that evolve gas when they react such as sodium bicarbonate and acetic acid. Once the connector 87 is heated and the barrier 92 melts, the reactants 88 and 90 react to evolve a gas which pressures the piston 54 and the slug of solder 28 toward the open end of the sleeve once the slug of solder has melted.

The barrier 92 can be eliminated if the reactants do not react or do not exert excessive pressure until reaching an elevated temperature of at least greater than 100° C.

Also a powder can be used that releases a gas at an elevated temperature.

Pressuring means are particularly useful in one or both sleeves of a splice connector having first and second sleeves in electrically conductive connection. With such a connector, a first conductor is connected in the first sleeve. Then, a second conductor is connected to the connector by placing the second conductor in the second sleeve, heating the slug of solder in the second sleeve to at least Tm while simultaneously maintaining the second conductor in the second sleeve against the force of the pressuring means. The pressuring means forces the molten solder toward the open end of the sleeve to completely fill the space between the second conductor and the second sleeve with solder. Thus, it is not necessary to move the second conductor and the connector toward each other after the first conductor is connected.

FIG. 8 shows a conductor 16 wrapped in a flexible sheet of wrapping 96 so that the conductor 16 can fit into a connector having a sleeve with an internal diameter too large for the unwrapped conductor. The wrapping 96 can comprise a flexible metallic sheet having a solid coating of solder on one or both surfaces. The wrap can be made of aluminum of about 5 to about 20 mils thick with a coating of solder, the same type used for the plug of about 1 to 2 mils thick. The wrap can have markings thereon to identify the length required for conductors of different diameter. Thus, a kit can be provided comprising a connector and pre-marked wrapping so that a single kit can accommodate a large number of sizes of conductors.

A connector can be provided with a metallic insert that is pretinned on its inner peripheral surface. With reference to FIG. 9, the splice connector 100 comprises two sleeves 102, one of which is provided with a metallic insert 104 having a solid coating 106 of solder on its inner peripheral surface. The insert 104 is rotatably mounted in the sleeve 102. As shown in FIG. 10, the inner wall 108 of the insert is non-circular in transverse cross-section. This allows the connector 100 to be used for conductors that are non-circular in transverse cross-section, and particularly the conductors of sectored high power cables.

An important feature is that the insert 104 is rotatable. This allows the insert to be aligned with the conductor so the conductor can be inserted into the insert. Without such a rotatable insert, alignment can be impossible once the splice connector 100 has been connected to a first conductor. After this first connection, it is impossible to rotate the connector to achieve alignment, and often the second conductor cannot be rotated.

Different features of the present invention described above can be used alone or in combination. For example, inserts 104, pressuring means, wrapping 96, and view ports 48 can be used alone or in combination, and can be used with both splice connectors and termination connectors.

The components needed to make a connection according to the present invention can be provided as a kit. For example, a kit can contain a pretinned sleeve having a slug of solder therein, or the slug of solder can be provided separately in the kit. Futher, the kit can have a variety of sizes of slugs of solder to accommodate different sizes of cables. Further, the kit can include wrapping, inserts, and fasteners 56.

Figure 1A:
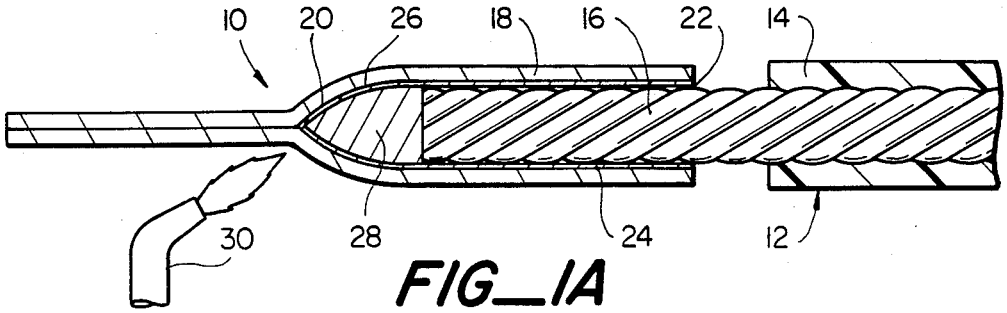
FIG. 1A shows in transverse cross-section a connector being used to terminate a power cable in accordance with the present invention.
Figure 1B:
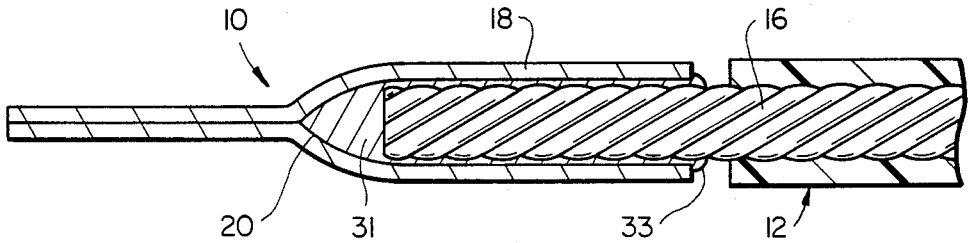
FIG. 1B shows the termination formed with the connector of FIG. 1A.

It should be realized that the barrier at the "closed" end of a sleeve can be (1) the wall of the sleeve itself as in FIG. 1A; (2) an installed barrier such as barrier 46 in FIG. 2; or (3) can in effect be the piston 28. An example of this third version is a self-activated two sleeve splice connector where there is no barrier 46 and a single spring is used to power two pistons, one piston in each sleeve.

These and other features of the present invention will be become better understood with reference to the following examples.

EXAMPLE 1

A termination connector 10 having the form shown in FIG. 1A was formed from a tube made of 6061 aluminum alloy that was 4½ inches long. One end of the tube was crimped closed to produce a sleeve about 2 inches long. The sleeve had an internal diameter of 35/64 inch and an outer diameter of ¾ inch. The inner peripheral wall of the sleeve was pretinned with Neptune-S in a thickness of about 5 mils. Sixteen grams of Neptune-S was placed at the closed end of the sleeve.

The sleeve was used to make a connection with 4 gauge size stranded aluminum condutor by simultaneously pushing the conductor toward the closed end of the sleeve and melting the solder.

A conventional crimped termination was made at the other end of the conductor. A tensile force was then applied to the assembly. The crimped connection failed while the connection made with the connector 10 held fast.

EXAMPLE 2

A splice connector 32 having the configuration shown in FIG. 2, except without a view hole 48, was made from a 4½ inches long tube made of aluminum 6061 alloy. The tube had an internal diameter of 35/64 inch and an outer diameter of ¾ inch. A cylindrical block of ½ inch thickness was press fitted into the center of the tube, thereby forming two sleeves, each of which was pretinned with Neptune-S solder. A slug of Neptune-S solder weighing 16 grams was placed at the closed portion of each sleeve. A first #4 gauge stranded aluminum conductor was connected to one of the sleeves by simultaneously pushing the conductor toward the closed end of the sleeve while melting the solder therein. Thereafter, a second stranded #4 gauge aluminum conductor was connected to the connector by pushing the conductor toward the closed portion of the second sleeve while simultaneously melting the solder therein.

EXAMPLE 3

A termination connection and a splice connection were made as described in Examples 1 and 2 except the conductors were 1,000 MCM stranded aluminum conductor and the termination connector and splice connector were correspondingly larger. Heat cycle tests are currently under way using a heat cycle period of 4 hours on, 2 hours off, a current of 1100 amps and a maximum temperature during each cycle of 130° C. The tests have been under way for three weeks and so far the connections have passed the tests in that the temperature rise of the connections has been substantially the same as the temperature rise of the conductors themselves.

From the above description, it is apparent that significant advantages compared to prior art techniques are obtained from use of the connectors and the method of the present invention. For example, the method is safe, and requires no bulky equipment, only using a simple torch. The connectors are easy to use and connections formed are not craft sensitive. Moreover, connections can be made even with cables having insulation formed from oil saturated paper.

The resultant connection can handle thermal cycling without failure, remains intact even under high tensile forces, and can be used with cables over 1,000 MCM in size, where crimps often can not be used.

Although the present invention has been described in considerable detail with reference to certain preferred versions thereof, other versions are possible. For example, the barrier 46 can be eliminated from a splice connector, and a single means for pressuring solder such as a spring can be used for simultaneously pressuring both slugs of solder toward both open ends of the connector. Further, small diameter cables can be connected to large diameter conductors without using wrapping 96. Also, although the sleeve has been referred to throughout as being "tubular", the sleeve may be made in the form of two (or more) longitudinally split partial sleeves ("clam-shells"), which may be assembled about the conductor(s) to form the tubular sleeve for use. Therefore, the spirit and scope of the appended claims should not be limited to the description of the preferred versions contained herein.

What is claimed is:

1. An electrically conductive connector for electrical conductors comprising:

(a) at least one metallic tubular sleeve having an open end for receiving an electrical conductor and a closed end, the peripheral inner wall of the sleeve being pretinned, the sleeve being sized to receive a slug of solder therein proximate to the closed end; and (b) means within the sleeve for pressuring the slug of solder toward the open end of the sleeve to fill the space between the conductor and the sleeve with solder at Tm, the temperature at which the slug of solder melts.

2. The connector of claim 1 including a slug of solder in the sleeve proximate to the closed end of the sleeve.

3. The connector of claim 2 in which the slug of solder is attached to the inner peripheral wall of the sleeve, and the pressuring means biases the slug of solder toward the open end of the sleeve at room temperature.

4. The connector of claim 3 in which the pressuring means comprises a spring positioned between the slug of solder and the closed end of the sleeve.

5. The connector of claim 1 in which the pressuring means produces a force at Tm of at least 10 psi.

6. The connector of claim 1 in which the pressuring means comprises heat expandable metal.

7. The connector of claim 6 in which the heat expandable metal is in the form of a spring.

8. The connector of claim 1 in which the pressuring means comprises a swellable polymer that swells at a temperature no greater than Tm.

9. The connector of claim 3 in which the pressuring means comprises a gas.

10. The connector of claim 1 in which the pressuring means comprises a container containing pressurized gas, the container including means for releasing the gas at a temperature greater than 100° C. and up to Tm.

11. The connector of claim 1 in which the pressuring means comprise reactants that react together to evolve a gas, the reactants being separated by a barrier that allows the reactants to react at a temperature greater than 100° C. and up to Tm.

12. The connector of claim 1 in which the pressuring means comprises reactants that evolve gas when they react, the reactants being reactive only at a temperature greater than 100° C. and up to Tm.

13. The connector of claim 2 including a metallic barrier between the slug of solder and the pressuring means, the barrier melting at a temperature greater than Tm, the barrier being axially slideable within the sleeve.

14. The connector of claim 13 in which the barrier is pretinned.

15. The connector of claim 13 in which the pressuring means comprises a material that is a fluid at Tm, and wherein the connector comprises a sealing member for preventing leakage of the fluid past the barrier.

16. The connector of claim 1 comprising two sleeves in electrically conductive connection with each other.

17. The connector of claim 16 in which both sleeves have pressuring means therein.

18. The connector of claim 2 in which the slug of solder is sufficiently large that when a stranded conductor is inserted into the sleeve and the solder is melted, the solder completely fills interstices in the conductor, fills the space between the conductor and the inner wall of the sleeve, and extrudes out of the open end of the sleeve.

19. The connector of claim 1 including a metallic tubular insert rotatably positioned in the sleeve, the peripheral inside wall of the insert being pretinned, the inside wall being non-circular in transverse cross-section.

20. The connector of claim 1 including a view hole through the wall of the sleeve proximate to the open end of the sleeve for determining when the slug of molten solder has been extruded to a position proximate to the open end of the sleeve.

21. The connector of claim 1 including a mounting hole through the wall of the sleeve for attaching fastening means to the connector for holding an electrical conductor in place as the pressuring means pressures molten solder towards the open end of the sleeve.

22. A method for connecting an electrical conductor comprising:

(a) selecting an electrically conductive connector comprising:

(i) at least one metallic tubular sleeve having an open end for receiving an electrical conductor and a closed end, the peripheral inner wall of the sleeve being pretinned;

(ii) a slug of solder in the sleeve proximate to the closed end of the sleeve; and (iii) means within the sleeve for pressuring the slug of solder towards the open end of the sleeve to fill the space between the conductor and the sleeve with solder at Tm, the temperature at which the slug of solder melts;

(b) placing an electrical conductor into the sleeve;

(c) heating the solder to at least Tm while simultaneously maintaining the conductor in the sleeve against the force of the pressuring means, the pressuring means forcing the molten solder towards the open end of the sleeve to fill the space between the conductor and the sleeve with solder; and (d) cooling the connector and conductor.

23. The method of claim 22 in which the step of heating comprises heating the solder until a small portion of the solder extrudes out of the open end of the sleeve.

24. A kit of parts for forming an electrically conductive connection with an electrical conductor comprising:

(a) an electrically conductive connector comprising at least one metallic tubular sleeve having an open end for receiving an electrical conductor and a closed end, the peripheral inner wall of the sleeve being pretinned; and (b) at least one metallic tubular insert sized to be rotatably positioned in the sleeve, the inside wall of the insert being pretinned and non-circular in transverse cross-section.

25. The kit of claim 24 including at least one slug of solder for placement in the sleeve proximate to the closed end thereof.

26. The kit of claim 24 in which the sleeve has a slug of solder therein proximate to the closed end.

27. An electrically conductive connector for an electrical conductor comprising:

(a) at least one metallic tubular sleeve having an open end for receiving an electrical conductor and a closed end, the peripheral inner wall of the sleeve being pretinned;

(b) a slug of solder in the sleeve proximate to the closed end of the sleeve; and (c) a metallic tubular insert rotatably positioned in the sleeve, the periphral inner wall of the insert being pretinned and non-circular in transverse cross-section.

28. The connector of claim 27 comprising two such sleeves, each sleeve containing a slug of solder, and at least one of the sleeves having such an insert therein.

29. A method for splicing first and second electrical conductors together comprising the steps of:

(a) selecting an electrically conductive connector comprising:

(i) first and second metallic sleeves in electrically conductive connection with each other, each sleeve having an open end for receiving a conductor and a closed end, the peripheral inner wall of each sleeve being pretinned;

(ii) a slug of solder in each sleeve proximate to the closed end of the sleeve; and (iii) at least within the second sleeve, means for pressuring the slug of solder towards the open end of the sleeve to fill the space between the conductor and the sleeve with solder at Tm, the temperature at which the slug of solder in the second sleeve melts;

(b) connecting the first conductor to the connector by placing the first conductor in the first sleeve and heating the first sleeve to a temperature sufficiently high to melt the slug of solder in the first sleeve; and (c) connecting the second conductor to the connector by placing the second conductor in the second sleeve, heating the slug of solder in the second sleeve to at least Tm while simultaneously maintaining the second conductor in the second sleeve against the force of the pressuring means, the pressuring means forcing the molten solder toward the open end of the sleeve to fill the space between the second conductor and the second sleeve with solder.

* * * * *

UNITED STATES PATENT AND TRADEMARK OFFICE

CERTIFICATE OF CORRECTION

PATENT NO. : 4,634,213

DATED : January 6, 1987

INVENTOR(S) : LARSSON, PARKER, RATZLAFF

It is certified that error appears in the above-identified patent and that said Letters Patent is hereby corrected as shown below:

In the Abstract, line 10,"accommoduate" should be --accommodate--

Col. 2, line 40, delete the first instance of "as" and insert in lieu thereof --so--.

Col. 2, line 52, delete "time" and insert in lieu thereof --the--

Col. 2, line 60, delete "of" and insert in lieu thereof --at--.

Col. 3, line 39, delete "large" and insert in lieu thereof --larger--.

Col. 7, line 4, delete "stat" and insert in lieu thereof --star--.

Signed and Sealed this

Seventh Day of April, 1987

*Attest:*

*Attesting Officer*

DONALD J. QUIGG

*Commissioner of Patents and Trademarks*